United States Patent [19]

Edwards et al.

[11] Patent Number: 5,040,221

[45] Date of Patent: Aug. 13, 1991

[54] COMPACT ELECTROACOUSTICAL TRANSDUCING WITH FLAT CONDUCTING TINSEL LEADS CRIMPED TO VOICE COIL ENDS

[75] Inventors: Robert Edwards, Dudley; John Larson, Newton; Brandon B. Westley, Westboro, all of Mass.

[73] Assignee: Bose Corporation, Framington, Mass.

[21] Appl. No.: 798,559

[22] Filed: Nov. 15, 1985

[51] Int. Cl.[5] ..... H04R 25/00

[52] U.S. Cl. ..... 381/194; 381/192; 381/197

[58] Field of Search ..... 179/115.5 ME, 115.5 R, 179/115.5 VC; 174/84 C; 428/577, 600, L929; 381/192, 194, 197

[56] References Cited

U.S. PATENT DOCUMENTS

| | | | |
|---|---|---|---|
| 3,129,995 | 4/1964 | Brown | 179/84 C |
| 3,358,088 | 12/1967 | Gault | 381/194 |
| 3,525,127 | 8/1970 | Hollingsworth | 428/600 |
| 3,616,529 | 11/1971 | Iding | 381/194 |
| 3,711,659 | 1/1973 | Bremseth | 381/194 |
| 4,151,364 | 4/1979 | Ellis | 174/84 C |
| 4,158,756 | 6/1979 | Keezer | 179/115.5 R |
| 4,539,442 | 9/1985 | Puls et al. | 179/115.5 VC |

FOREIGN PATENT DOCUMENTS

| | | | |
|---|---|---|---|
| 647396 | 12/1950 | United Kingdom | 179/115.5 VC |
| 776280 | 6/1957 | United Kingdom | 179/115.5 VC |

OTHER PUBLICATIONS

Amitronics, Inc., New Product Information Bulletin, No. 379, Mar. 1979.

*Primary Examiner*—Jin F. Ng
*Assistant Examiner*—Jason Chan
*Attorney, Agent, or Firm*—Fish & Richardson

[57] ABSTRACT

A loudspeaker driver has a plastic basket having front and rear portions. The front portion is formed with six radial ribs extending between a central motor cup support and an annular rim. A cup-shaped front pole piece is molded into the pole support and formed with an axial groove for accommodating an axial lead extending from the front end of a voice coil that moves axially in a gap between the circumferential wall of the front pole plate and a circular rear pole plate and circular disk neodymium disk magnet sandwiched between the rear pole plate and the closed end of the front pole plate. Flat tinsel leads are crimped to ends of the voice coil and brought out through slits in the cone to terminals in opposite sides of the rear portion of the basket. The circumferential edge of the cone is clamped between the front and rear portions of the basket and ultrasonically bonded to an annular surface on the rear of the front portion. The rear end of the cone is cemented to the rear of the voice coil support just forward of where the spider collar is fastened to the voice coil support. The circumferential edge of the spider is ultrasonically bonded to a depressed annular rim at the rear of the rear portion of the basket.

2 Claims, 4 Drawing Sheets

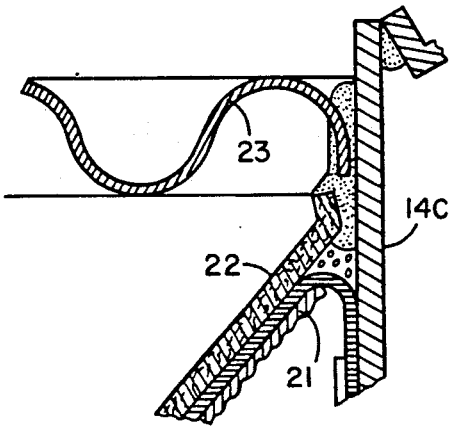
FIG. 4
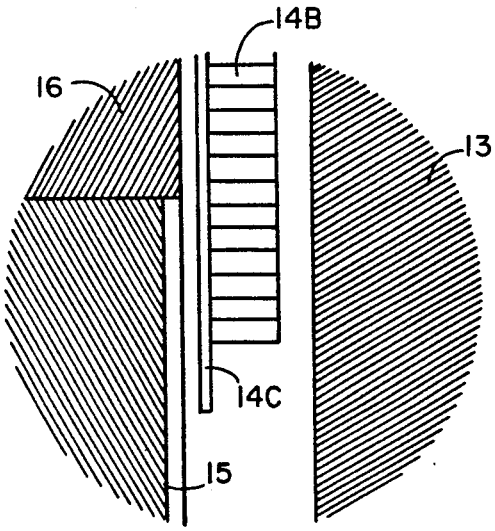
FIG. 5
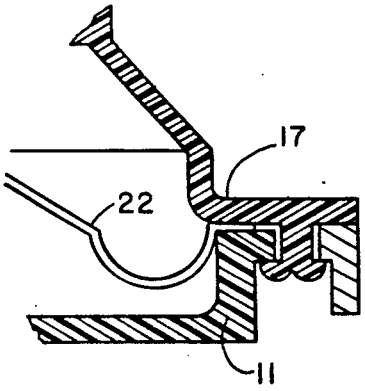
FIG. 6
FIG. 7
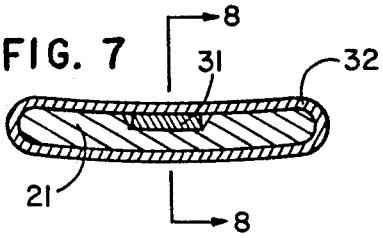
FIG. 8
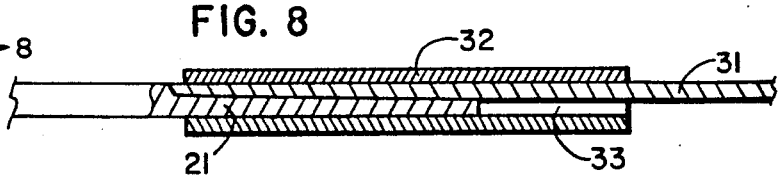

COMPACT ELECTROACOUSTICAL TRANSDUCING WITH FLAT CONDUCTING TINSEL LEADS CRIMPED TO VOICE COIL ENDS

The present invention relates in general to compact electro-acoustical transducing and more particularly concerns a novel loudspeaker driver that affords high electro-acoustical transducing performance in a compact structure that is relatively easy and inexpensive to fabricate.

BACKGROUND OF THE INVENTION

For background reference is made to U.S. Pat. No. 4,061,890 entitled LOUDSPEAKER WITH SINGLE LAYER RECTANGULAR WIRE VOICE COIL WOUND ON SLIT METAL BOBBIN WITH A NOTCH IN THE ADJACENT POLE PLATE of Thomas A. Froeschle granted Dec. 6, 1977, and U.S. Pat. No. 4,158,756 entitled DYNAMIC LOUDSPEAKER WITH PLASTIC BASKET ENCAPSULATING FRONT POLE PLATE of William J. Keezer granted June 19, 1979. These patents disclose a loudspeaker driver embodied in the commercially available BOSE 901 loudspeaker system and the Delco-GM-Bose music system. These patents disclose a loudspeaker driver having a molded plastic basket made of thermoplastic polyester with glass fill and a front pole plate of low reluctance magnetic material molded into the base of the basket with a keyed central bore. The motor structure is located behind the front pole plate. The edge of the spider that resiliently supports the voice coil is fastened to an annular surface inside the basket. A low resistance single layer anodized aluminum rectangular wire voice coil is wound on a slit anodized aluminum bob-bin. There is a notch in the adjacent pole plate for the return length of the voice coil wire. This loudspeaker driver exhibits excellent electro-acoustical and mechanical characteristics and operates satisfactorily under a wide range of environmental conditions.

It is an important object of this invention to provide an improved loudspeaker driver.

SUMMARY OF THE INVENTION

According to the invention, there is a loudspeaker driver basket having the motor structure located in front of the cone with the spider behind the motor structure resiliently supporting the rear edge of the voice coil. The basket is preferably made of plastic and is formed with rivets ultrasonically bonding terminals to the basket. Flat flexible tinsel leads are brought out through slits in the cone to the terminals. The basket is formed with acoustically transparent structurally supporting radial ribs in which a cup of low reluctance magnetic material is molded formed with an axial notch on the inside surface to accommodating a flexible voice coil lead.

Numerous other features, objects and advantages of the invention will become apparent from the following specification when read in connection with the accompanying drawing in which:

BRIEF DESCRIPTION OF THE DRAWING

FIG. 4 is an enlarged detail view illustrating the junction among spider, cone and voice coil support;

FIG. 5 is an enlarged view of a portion of the annular motor gap;

FIG. 6 is a sectional view through section 6—6 of FIG. 2;

FIG. 7 is a transverse sectional view of the tinsel-voice coil joint; and

FIG. 8 is a sectional view through section 8—8 of FIG. 7;

DESCRIPTION OF THE PREFERRED EMBODIMENTS

Figure 1:
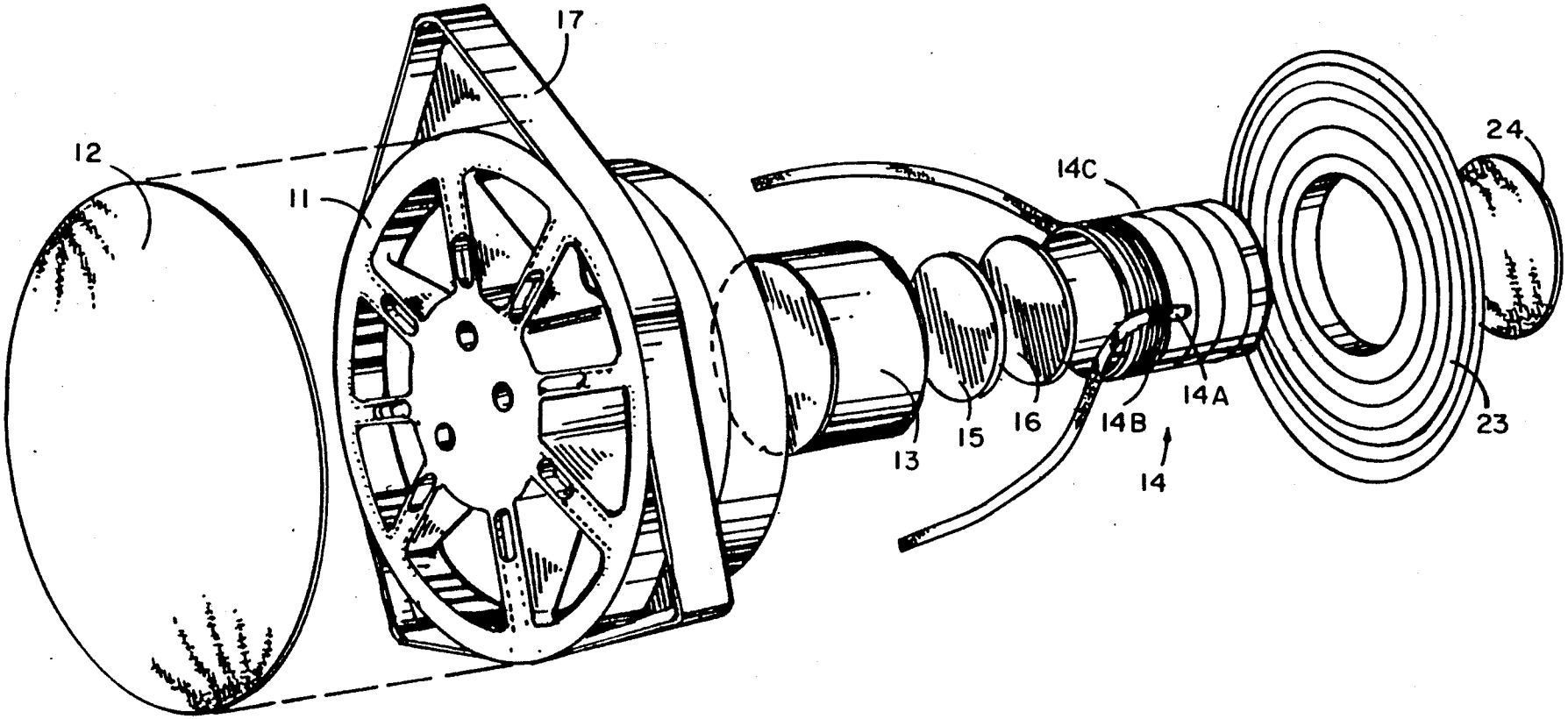
FIG. 1 is a mostly exploded view of a loudspeaker driver according to the invention.
Figure 2:
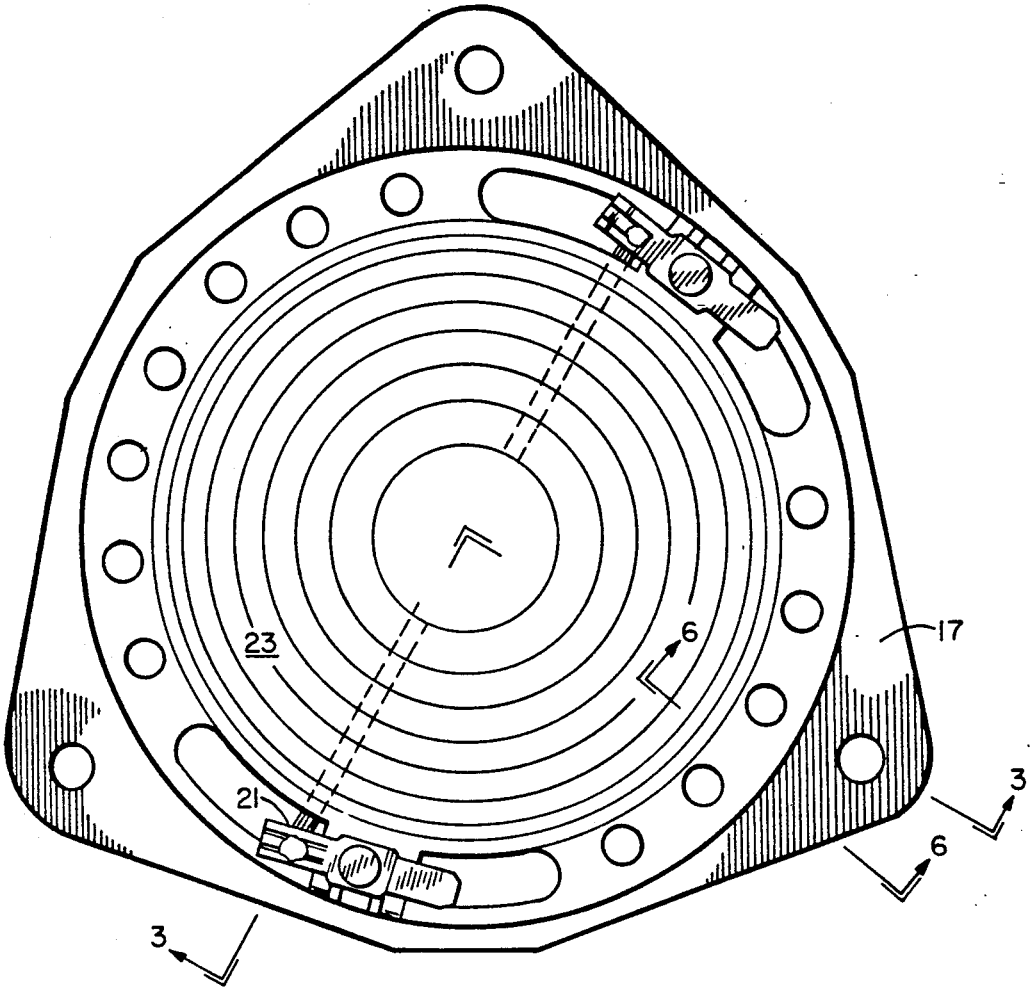
FIG. 2 is a plan rear view of an embodiment of the invention.
Figure 3:
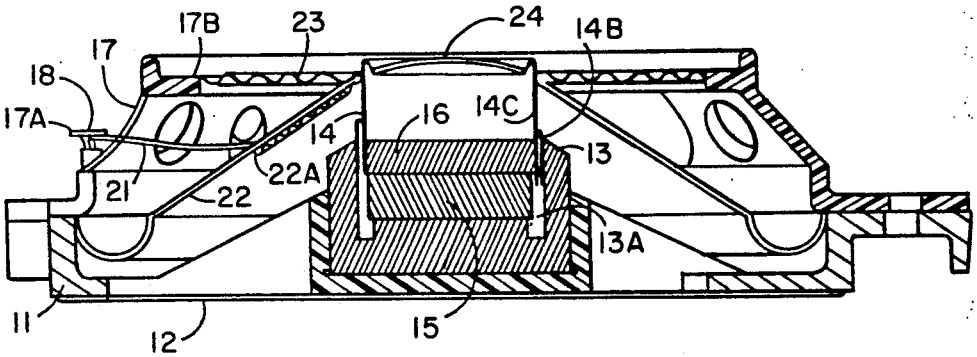
FIG. 3 is a sectional view through section 3—3 of FIG. 2.

With reference now to the drawing and more particularly FIGS. 1-3 thereof, there are shown respectively a mostly exploded view, rear plan view and sectional view through section 3—3 of FIG. 2, of a loudspeaker driver according to the invention having a plastic basket front portion 11 covered by a circular scrim 12 and supporting a rearwardly opening molded-in cup-shaped front pole piece 13 formed with an annular recess 13A for accommodating the front edge of voice coil assembly 14 and an axial recess for accommodating the axial lead 14A from the front end of voice coil 14B. Voice coil 14B is supported on an axial slit cylindrical aluminum sheet.

A neodymium circular disk magnet 15 is sandwiched between the closed end of front pole piece 13 and circular disk rear pole plate coacting with the front cup-shaped pole piece 13 to define an annular gap for accommodating voice coil assembly 14 with a radial magnetic field developed between rear pole plate 16 and the cylindrical wall of front pole piece 13.

A plastic basket rear portion 17 mates with plastic basket front portion 11 and is ultrasonically bonded thereto. Plastic basket rear portion 17 is formed with studs 17A comprising plastic rivets that secure terminals 18 to plastic basket rear portion 17. Terminals 18 are connected to respective ones of flat tinsel leds 21 crimped at the other end to a respective voice coil lead.

Flat tinsel conducting leads 21 are brought out through slits 22A oriented in a plane perpendicular to the axis of the loudspeaker assembly. The annular edge of cone 22 is clamped between mating annular surfaces of plastic basket front and rear portions 11 and 17.

Spider 23 resiliently supports the rear edge of voice coil assembly 14 and has its outer annular edge ultrasonically bonded to the recessed annular rim 17B. A dust cover 24 completes the assembly.

Referring to FIG. 4, there is shown an enlarged view illustrating the junction among spider 23, cone 22 and voice coil support 14C.

Referring to FIG. 5, there is shown an enlarged view of a portion of the annular motor gap between circular disk magnet 15, circular disk rear pole plate 16 and the upstanding circular wall of front pole piece 13.

Referring to FIG. 6, there is shown a view through section 6—6 of FIG. 2 illustrating the manner in which plastic basket front and rear portions 11 and 17 are fastened together with the annular rim of cone 22 therebetween.

Referring to FIG. 7, there is shown a transverse sectional view of the tinsel-voice coil joint illustrating the connection between voice coil wire and flat tinsel lead, and FIG. 8 is a view through section 8—8 of FIG. 7. Tinsel lead 21 and voice coil wire 31 are in overlapping relationship surrounded by crimp band 32 that is pressed flat as shown to insure good electrical and mechanical contact with tinsel 21. There is a small void volume 33 visible in FIG. 8 between coil wire 31 and crimp band 32 to afford space for coil wire 31 to move without damage from crimp band 32.

Figure 9:
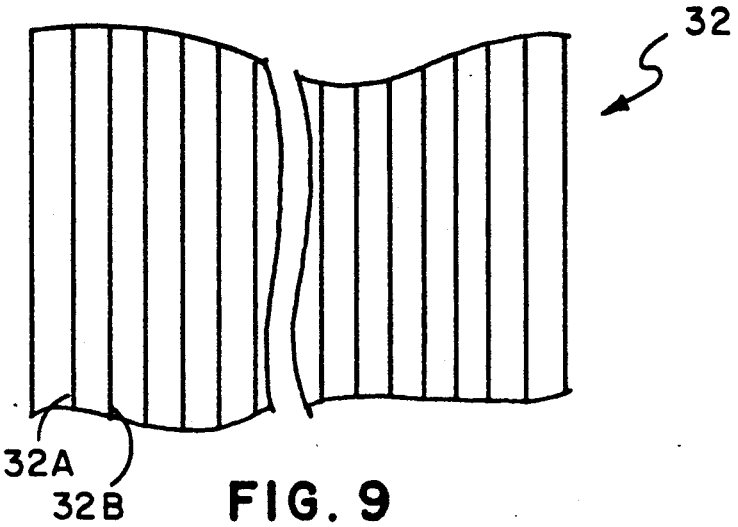
FIG. 9 is a fragmentary plan view of a preferred form of crimp stock according to the invention.
Figure 10:
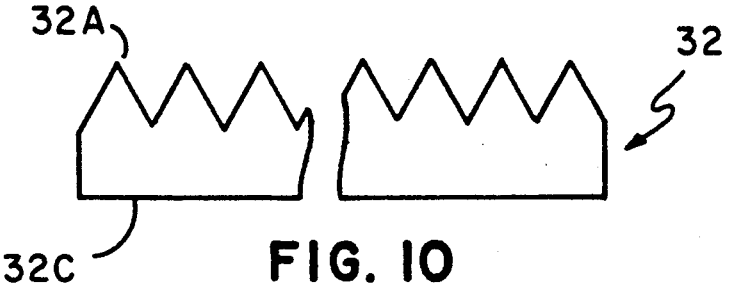
FIG. 10 is a fragmentary elevation view of the crimp stock of FIG. 9.

Referring to FIGS. 9 and 10, there are shown fragmentary plan and elevation views, respectively, of crimp band 32 made of a preferred form of crimp stock. As best seen in FIG. 10, the preferred crimp stock is of sawtooth cross section having peaks such as 32A above valleys such as 32B. Typically the material is half-hard brass finished with thick tin plate of plating thickness within the range of 0.001 to 0.0003 inches. The thickness from the base line 32C to a peak such as 32A is typically about 0.008" and the distance from base 32C to a valley such as 32B is typically about 0.00035". The length of a crimp 32 is typically about 0.115".

This aspect of the invention solved a serious problem. When using flat crimp stock, it was discovered that the lead resistance varied with cone motion, introducing an undesired variable resistance modulation to the reproduced sound signal. It was discovered that the cause of this problem was variation in the resistance in the crimped connection. The crimp stock structure shown in FIGS. 9 and 10 overcame this problem. This structure provides significantly greater surface area for establishing contact with the conducting lead 31. Wire 31 stretches around points, such as 32A, past any insulation in the wire to establish a low resistance contact. The fine structure that is at most 4 mils peak-to-valley avoids destroying wire 31 while establishing this good contact.

There has been described a novel full-range loudspeaker driver characterized by excellent electro-acoustical and mechanical properties that is especially compact and produceable on a mass production basis. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A loudspeaker driver comprising.

basket means for supporting components of said loudspeaker driver, first and second terminals secured to said basket means, voice coil means having first and second ends, means for supporting said voice coil mans in said basket means, first and second flat tinsel conducting leads interconnecting said first and second terminals with said first and second ends respectively of said voice coil means, wherein said loudspeaker driver includes a cone secured to said voice coil means supported in said basket means and said cone is formed with first and second slits near said voice coil means, said first and second flat tinsel leads passing through said first and second slits respectively, and flat crimp means for mechanically and electrically bonding said first and second flat tinsel conducting leads to said first and second voice coil ends respectively, wherein said flat crimp means comprises crimp stock of conducting material of the order of 10 mils thick formed with a fine pointed pattern that is at most 4 mils peak-to-valley in at least one surface thereof for snugly engaging a voice coil end.

2. A loudspeaker drive comprising, basket means for supporting components of said loudspeaker driver, first and second terminals secured to said basket means, voice coil means having first and second ends, means for supporting said voice coil means in said basket means, first and second flat tinsel conducting leads interconnecting said first and second terminals with said first and second ends respectively of said voice coil means, flat crimp means for mechanically and electrically bonding said first and second flat tinsel conducting leads to said first and second voice coil ends respectively, wherein said loudspeaker driver includes a cone secured to said voice coil means supported in said basket means and said cone is formed with first and second slits near said voice coil means, said first and second flat tinsel leads passing through said first and second slits respectively, wherein said first and second flat tinsel leads extend radially along said cone from said first and second voice coil ends respectively through said first and second slits respectively to said first and second terminals respectively, and wherein said flat crimp means comprises crimp stock of conducting material of the order of 10 mils thick formed with a fine pointed pattern that is at most 4 mils peak-to-valley on one surface thereof for establishing good electrical and mechanical contact with a voice coil end.

* * * * *